US011474548B2

(12) United States Patent
Pan

(10) Patent No.: US 11,474,548 B2
(45) Date of Patent: Oct. 18, 2022

(54) DIGITAL LOW-DROPOUT REGULATOR (DLDO) WITH FAST FEEDBACK AND OPTIMIZED FREQUENCY RESPONSE

(71) Applicant: Wuxi Petabyte Technologies Co., Ltd., Wuxi (CN)

(72) Inventor: Feng Pan, Fremont, CA (US)

(73) Assignee: WUXI PETABYTE TECHNOLOGIES CO, LTD., Wuxi (CN)

( * ) Notice: Subject to any disclaimer, the term of this patent is extended or adjusted under 35 U.S.C. 154(b) by 0 days.

(21) Appl. No.: 16/840,225

(22) Filed: Apr. 3, 2020

(65) Prior Publication Data

US 2021/0311516 A1 Oct. 7, 2021

(51) Int. Cl.
*G05F 1/575* (2006.01)
*G05F 1/46* (2006.01)

(52) U.S. Cl.
CPC ..... *G05F 1/575* (2013.01); *G05F 1/468* (2013.01)

(58) Field of Classification Search
CPC ..... G05F 1/00; G05F 1/10; G05F 1/46; G05F 1/461; G05F 1/468; G05F 1/56; G05F 1/562; G05F 1/563; G05F 1/565; G05F 1/575; G05F 1/59; G05F 1/595; G05F 1/613; G05F 1/614; G05F 1/618; H02M 2001/0003; H02M 2001/0016; H02M 2001/0019; H02M 1/0003; H02M 1/0016; H02M 1/0019; H01L 27/115; H01L 27/11502–11514
USPC ..... 323/222–226, 266, 268–275, 280, 323/282–286, 304, 311–317, 351; 327/538–543
See application file for complete search history.

(56) References Cited

U.S. PATENT DOCUMENTS 8,115,463 B2 * 2/2012 Wang ..... G05F 1/575 323/280
9,514,797 B1 * 12/2016 Chu ..... G11C 11/221
9,915,963 B1 * 3/2018 Wu ..... G05F 1/575
2004/0164789 A1 8/2004 Leung et al.
2006/0273771 A1 * 12/2006 van Ettinger ..... G05F 1/575 323/273
2008/0284395 A1 * 11/2008 Wang ..... G05F 1/56 323/282
2019/0064862 A1 * 2/2019 Pan ..... G05F 1/561

* cited by examiner

*Primary Examiner* — Thienvu V Tran
*Assistant Examiner* — Carlos O Rivera-Perez
(74) *Attorney, Agent, or Firm* — Bayes PLLC

(57) ABSTRACT

Embodiments relate to digital low-dropout (DLDO) with fast feedback and optimized frequency response. Certain embodiments may relate more particularly to ferroelectric memory circuit configurations. For example, a low dropout regulator may include a first circuit path configured to regulate an input voltage to an output voltage at a load, wherein the first path comprises a first transistor. The apparatus may also include a second circuit path configured to feed back an error signal based on the input voltage and the output voltage, wherein the second circuit path comprises an error amplifier.

11 Claims, 5 Drawing Sheets

DIGITAL LOW-DROPOUT REGULATOR (DLDO) WITH FAST FEEDBACK AND OPTIMIZED FREQUENCY RESPONSE

BACKGROUND

Embodiments of the present disclosure relate to a digital low-dropout regulator (DLDO) with fast feedback and optimized frequency response. Certain embodiments may be applied to a variety of circuits. For example, certain embodiments may be used for any applications that benefit from high bandwidth, low quiescent current and small die size. For example, certain embodiments may be applicable to ferroelectric memory circuit configurations.

While Flash random access memory (RAM) has been a popular choice for bit storage, ferroelectric RAM (FRAM) may provide a lower power usage alternative. Thus, FRAM may be particularly suitable in power-limited low power operations situations, in view of FRAM's ability to use lower power than some alternatives. At the same time, this lower power situation may lead to challenges in voltage regulation, because there may be a small difference between the supply and load. When a voltage regulator is used, if the difference between the input voltage supply voltage and the input voltage becomes less than a dropout voltage threshold, the transistor of the voltage regulator can become ohmic and cease properly regulating voltage.

A low-dropout regulator, sometimes referred to simply as a low dropout or LDO, can be used to provide a stable power supply voltage despite variations in load impedance or in the power supply. LDOs can particularly be useful when there is a small difference between the supply voltage and output load voltage, which may occur in mobile devices. This small voltage difference may be present in FRAM circuits, and accordingly a low-dropout regulator may be of use to provide a stable power supply despite the various changes in load that may be experienced on, for example, a wordline of the FRAM.

SUMMARY

Embodiments of digital LDO with fast feedback and optimized frequency response are disclosed herein.

According to one aspect of the present disclosure, a low dropout regulator may include a first circuit path configured to regulate an input voltage to an output voltage at a load. The first path may include a first transistor. The low dropout regulator may also include a second circuit path configured to feed back an error signal based on the input voltage and the output voltage. The second circuit path may include an error amplifier.

In some embodiments, the first transistor may include a p-type transistor.

In some embodiments, the first circuit path may include a first resistor in series with the first transistor. The first resistor may be tuned to provide a predetermined power to the load.

In some embodiments, the low dropout regulator may also include a second resistor between the first circuit path and the second circuit path. The second resistor may be tuned to block current from the second circuit path to the first circuit path.

In some embodiments, the second circuit path may include a second transistor. The second transistor may be controlled by a same input as the first transistor. The input may be provided via a common node.

In some embodiments, the second transistor may include a p-type transistor.

In some embodiments, the second circuit path may further include a pair of complementary transistors between the error amplifier and the common node. The pair of complementary transistors may be configured to transmit either the input voltage or ground to the common node based on an output of the error amplifier as buffer for improving transient speed.

According to another aspect of the present disclosure, a low dropout regulator may include a voltage input line and a first switch connected to the voltage input line at a first node of the first switch. The low dropout regulator may also include a resistor connected to the first switch at a second node of the first switch and connected to an output node. The low dropout regulator may further include a feedback loop connected to a third node of the first switch and configured to control the first switch via the third node.

In some embodiments, the low dropout regulator may further include a second resistor connected to the output node and configured to block a path between the feedback loop and the output node.

In some embodiments, the feedback loop may include a second switch connected to the voltage input line at a first node of the second switch and connected to an error input of an error amplifier at a second node of the second switch.

In some embodiments, a third node of the second switch may be common with the third node of the first switch.

In some embodiments, the feedback loop may further include a pair of complementary switches configured to transmit, to the third node of the second switch and to the third node of the first switch, a selected one of the input voltage and ground.

In some embodiments, the error amplifier may be configured to control the pair of complementary switches based on the error input and a reference voltage.

BRIEF DESCRIPTION OF THE DRAWINGS

The accompanying drawings, which are incorporated herein and form a part of the specification, illustrate embodiments of the present disclosure and, together with the description, further serve to explain the principles of the present disclosure and to enable a person skilled in the pertinent art to make and use the present disclosure.

Embodiments of the present disclosure will be described with reference to the accompanying drawings.

DETAILED DESCRIPTION

Although specific configurations and arrangements are discussed, it should be understood that this is done for illustrative purposes only. A person skilled in the pertinent art will recognize that other configurations and arrangements can be used without departing from the spirit and scope of the present disclosure. It will be apparent to a person skilled in the pertinent art that the present disclosure can also be employed in a variety of other applications.

It is noted that references in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure or characteristic is described in connection with an embodiment, it would be within the knowledge of a person skilled in the pertinent art to affect such feature, structure or characteristic in connection with other embodiments whether or not explicitly described.

In general, terminology may be understood at least in part from usage in context. For example, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Certain embodiments of the present disclosure avoid the above-identified issues and provide various benefits and/or advantages. For example, certain embodiments may provide a high-speed design of an LDO circuit, which also has a low ripple. Furthermore, the implementation of certain embodiments may avoid adding unnecessary complexity to a designed circuit.

Certain embodiments may provide high-speed feedback to improve load response speed and lower output ripple. Additionally, certain embodiments may provide for frequency response adjustment through the split of output power switches: one for feedback control and another for providing load response with optimized frequency response.

Figure 1:
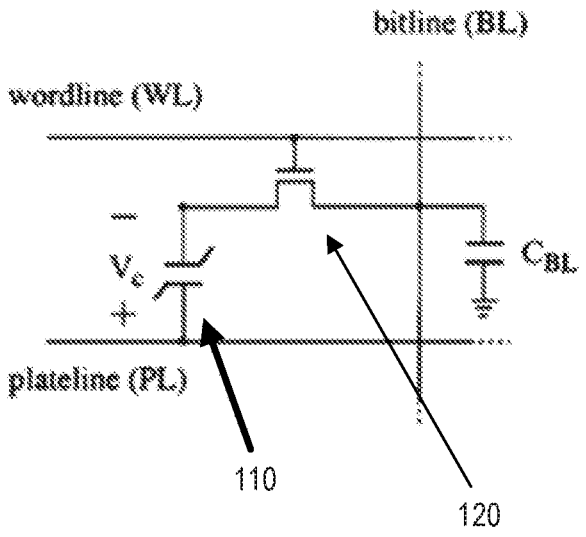
FIG. 1 illustrates a ferroelectric memory circuit.

FIG. 1 illustrates an FRAM circuit. The digital LDO according to certain embodiments of the present disclosure is not just for FRAM. A digital LDO as disclosed herein may be used for any applications that benefit from high bandwidth, low quiescent current and small die size. For example, any circuit that may benefit from a small decoupling capacitor may benefit from one or more of the digital LDO embodiments disclosed herein. FIG. 1 illustrates FRAM as an example of a circuit that may apply an embodiment of a digital LDO advantageously, without limitation.

As shown in FIG. 1, a bit can be stored as a voltage polarity of capacitor 110, having a voltage of $V_c$. Capacitor 110 is typically made from a film of ferroelectric material placed between two electrodes, which is why it is referred to as ferroelectric RAM. There can be a corresponding transistor 120 associated with capacitor 110. The voltage polarization stored in capacitor 110 persists even after the electric field producing the voltage has been removed. This is the reason this device is used for storing bits. Unlike some other forms of bit storage, the read process of the bit stored in capacitor 110 is destructive. The capacitor $C_{BL}$ is a circuit element representative of a total parasitic capacitance of the BL.

To determine the polarity of capacitor 110, both the wordline (WL) and the plateline (PL), sometimes referred to as a drive line, can be brought high. A sensing amplifier (not shown) can then be used to evaluate whether the voltage provided on the BL is above or below a threshold reference voltage. If the voltage is above the reference voltage, the BL can be driven to high, whereas if the voltage is below the reference voltage, the BL can be driven to low. The driving of the BL to high or low can be used to restore the polarity in the capacitor.

In circuits such as that shown in FIG. 1, the high-speed operation of the circuit may require a very high bandwidth LDO. Background approaches to providing an LDO are insufficient to the task or unnecessarily complex.

Figure 2:
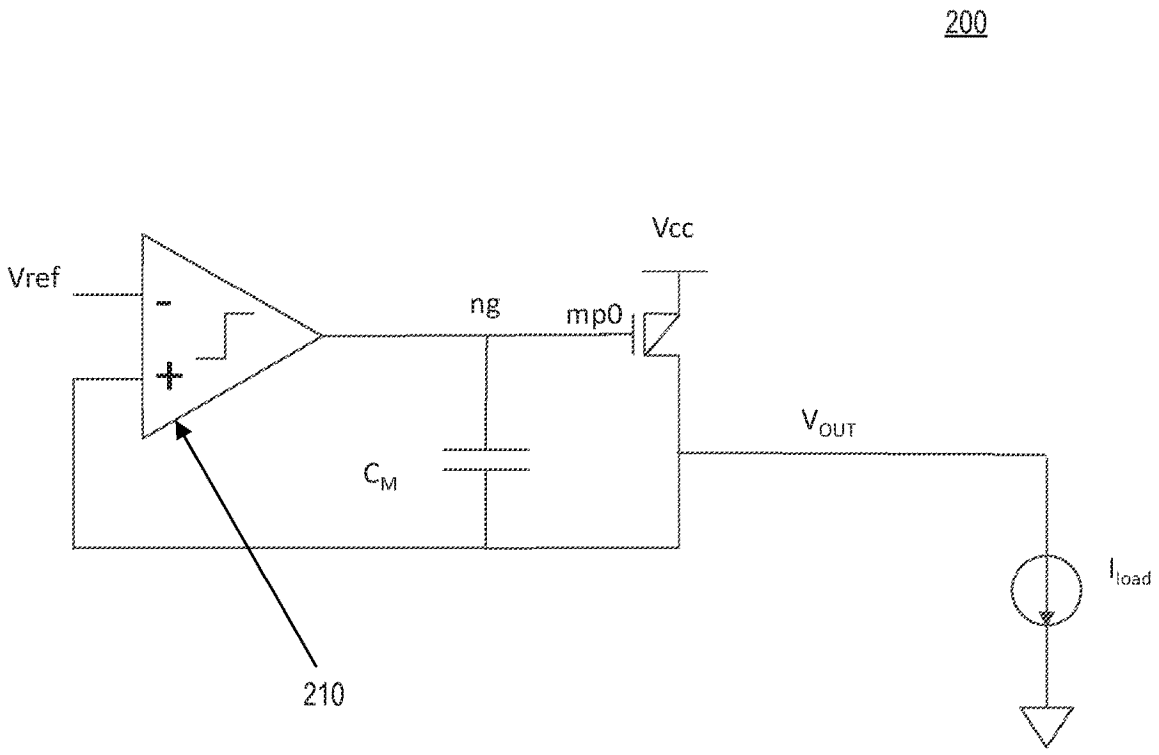
FIG. 2 illustrates a background LDO circuit.

For example, FIG. 2 illustrates a background LDO circuit. As shown, the low-dropout regulator (LDO) 200 includes a comparator 210, a transistor mp0, and a capacitor ($C_M$). The capacitor is shown as a Miller capacitance.

A first input terminal of the comparator 210 can be connected to a reference voltage (Vref). In some embodiments, the value of the reference voltage (Vref) can be determined based on the designed voltage of a load (shown as $I_{load}$) of the low-dropout regulator (LDO) 200. For example, according to the type of the load of the low-dropout regulator (LDO) 200, the value of the reference voltage (Vref) can be either fixed or variable. That is, the reference voltage (Vref) can be generated by a fixed voltage source, or can be generated by a circuit that can provide an adjustable voltage value.

A second input terminal of the comparator 210 can be connected to a first terminal of the transistor mp0. An output terminal of the comparator 210 can be connected to a control terminal of the transistor mp0.

A first terminal of the transistor mp0 can be connected to the load. A second terminal of the transistor mp0 can be connected to a power voltage (Vcc).

A first terminal of the capacitor (Cm) can be connected to the control terminal of the transistor mp0. A second terminal of the capacitor (Cm) can be connected to the first terminal of the transistor mp0, which is also connected to the output, and which presents output voltage $V_{OUT}$ to the load.

In some embodiments, the transistor mp0 can be a metal-oxide-semiconductor field-effect transistor (MOSFET), such as a p-channel MOSFET as shown in FIG. 1. The control terminal of the transistor mp0 can be the gate of the MOSFET, and the first terminal and the second terminal of the transistor mp0 can be the source and drain of the MOSFET respectively.

The error amplifier 210 can compare the magnitudes of the reference voltage (Vref) and the output voltage ($V_{OUT}$) that is outputting to the load. When the output voltage ($V_{OUT}$) is higher than the reference voltage (Vref), the node (Ng) located at the control terminal of the transistor mp0 is at a high level. In this case, the transistor mp0's driving strength is reduced. When the output voltage ($V_{OUT}$) is lower than the reference voltage (Vref), the node (Ng) is at a low level. In this case, the transistor mp0 is turned on to conduct a higher current to the load. Therefore, the output voltage ($V_{OUT}$) can be stabilized at the reference voltage (Vref) under all conditions through proper compensation. As an analog LDO, the trade-off among factors such as bandwidth, power consumption, stability, load regulation, line regulation, die size, and the like must be carefully considered. Normally for stability reason, the analog LDO may be compensated, which in turn may reduce its bandwidth of operation.

Figure 3:
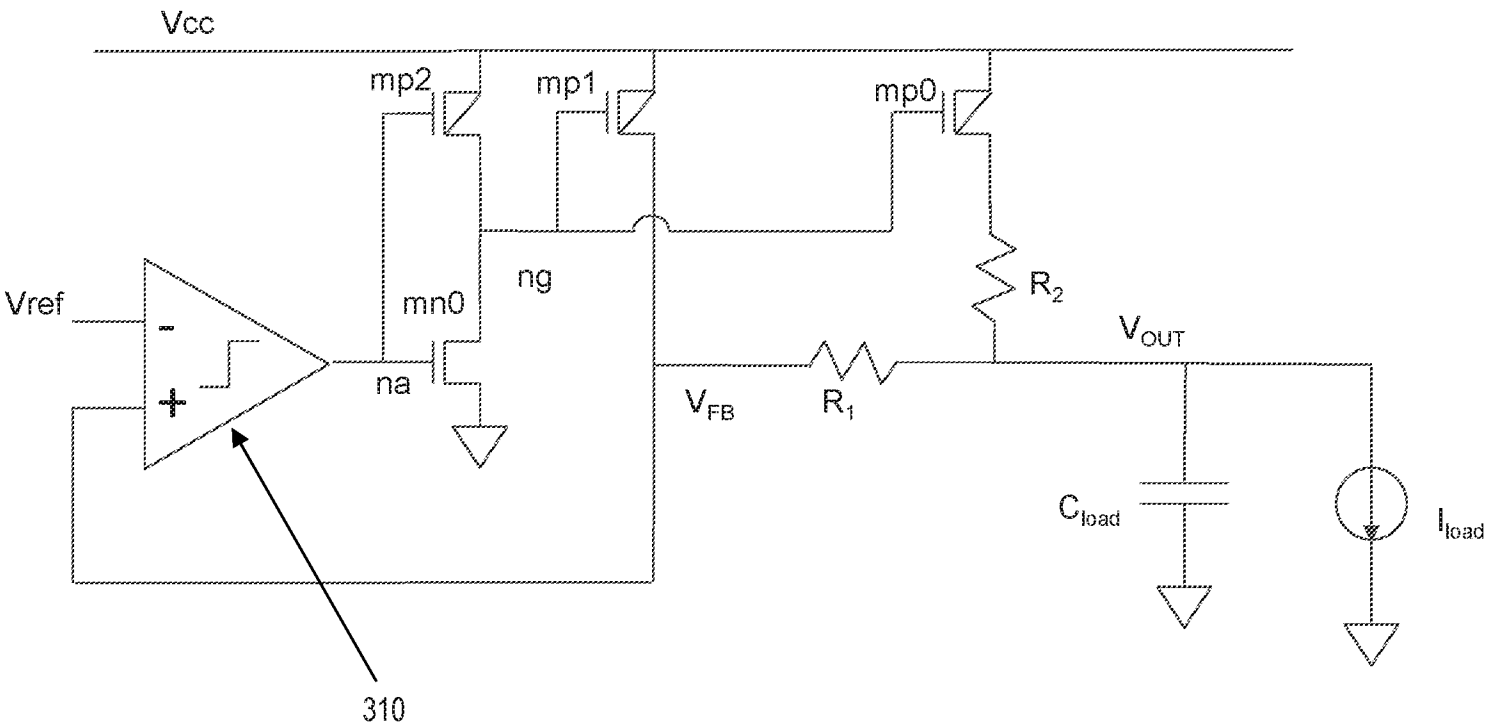
FIG. 3 illustrates a circuit according to certain embodiments.

FIG. 3 illustrates a circuit according to certain embodiments. As shown in FIG. 3, a circuit can include a plurality of transistors mn0, mp0, mp1, and mp2, as well as an error amplifier 310. The transistors can also be termed switches.

Other circuit elements that perform the same switching function may be substituted for transistors in certain embodiments. Other circuit features are also shown, as illustrated in FIG. 3 and discussed below. Certain embodiments are described as digital LDO because by nature the closed loop has more than two poles that are closely positioned in the frequency spectrum, and the output of the digital LDO would not be stable under fixed load current. In contrast, a properly compensated analog LDO would have stable output voltage under fixed load current. However, in the real world the load current would seldom be constant. Under such real condition, with the superposition of impulse response from load disturbance to the closed-loop system of analog LDO, the output voltage of analog LDO would never be a constant value, but would rather resemble noise. For digital LDO, through careful engineering, the output voltage could be regulated within an acceptable noise range based on specification, and the power consumption could be smaller than an analog LDO equivalent. Moreover, the circuit according to certain embodiments may have much smaller decoupling capacitance at a load due to the benefit of fully utilized digital circuit bandwidth under given technology.

Transistor mp0 can be configured to provide sourcing current for an output load. Thus, when mp0 is activated by bringing node ng low, voltage Vcc and resistor $R_2$ can generate an output voltage $V_{OUT}$, which can be combined with a load capacitance $C_{load}$ to provide the load current $I_{load}$. Voltage Vcc can be provided from a voltage source, not shown, over a voltage input line. The voltage source may ultimately be powered by, for example, a lithium-ion battery in a mobile device.

Transistor mp1 can similarly be activated by bringing node ng low. The internal resistance of transistor mp1 relative to the resistance of resistor $R_1$ can form a voltage divider that can generate greater feedback voltage, $V_{FB}$. Error amplifier 310 can compare $V_{FB}$ to a reference voltage, Vref. Based on the comparison, Error amplifier 310 can make node na go high or low. The feedback voltage may, in this example, be considered the error input to the error amplifier 310.

R2 can be tuned to meet output current load, while optimizing ripple and frequency response. Similarly, R1 can be adjusted to allow a certain shaped frequency response from the feedback of the output node.

In general, mp1 can be viewed as providing fast feedback response, $V_{FB}$, for the voltage amplifier, while mp0 provides the current load for the output load.

As a result of the above configuration and appropriate tuning, the circuit illustrated in FIG. 3 may provide high-speed feedback to improve load response and minimized output ripple. Additionally, there can be frequency response adjustment through the split of output power switches. The split mentioned here can refer to the split between mp0 providing load response with optimized frequency response and mp1 providing feedback control with R1 and R2 combination.

More particularly, the circuit shown in FIG. 3 may provide an apparatus that can serve as a low dropout regulator, for example, for a ferroelectric memory circuit. The apparatus can include a first circuit path, such as the path from Vcc to $V_{OUT}$ via transistor mp0. This first path may be configured to regulate an input voltage, for example, Vcc, to an output voltage, for example, $V_{OUT}$, at a load (shown as $I_{load}$). The first circuit path can also include a first resistor, $R_2$, in series with mp0. The first resistor can be tuned to provide a predetermined frequency response for the load. The apparatus can include a second circuit path from Vcc to $V_{FB}$ back through error amplifier 310 and including transistors mn0, mp1, and mp2. The second circuit path can be configured to feed back an error signal based on the input voltage and the output voltage. The second circuit path can be considered a fast feedback loop.

The apparatus can also include a second resistor, $R_1$, between the first circuit path and the second circuit path. The second resistor can be tuned to block current from the second circuit path to the first circuit path. One of the transistors of the second path, for example, mp1, can be controlled by the same input as mp0. This input can be provided via a common node, for example, node ng.

Transistors mp2 and mn0 of the second circuit path can be provided as a pair of complementary transistors between the error amplifier 310 and the common node ng. In other words, mp2 and mn0 can be configured such that when one is switched on, the other is switched off, and vice versa. The output could be considered as a digital output. This may be accomplished by, for example, providing two opposite types of transistors (p-type and n-type) provided with a common gate signal, such as the signal provided at node na. The pair of complementary transistors can be configured to transmit either the input voltage, Vcc, or ground to the common node ng based on an output of the error amplifier 310.

Certain embodiments may obtain bandwidth for the LDO from the use of the digital circuit. For example, in FIG. 3, the transistors and amplifier, i.e., error amplifier 310 and mn0, mp0, mp1, and mp2, can be considered digital aspects of the circuit.

As may be understood from the above, the output load may change over time. Thus, $I_{load}$ may not be constant. If the load suddenly changes, in a purely analog system, the bandwidth may not be high enough to accommodate this change. Accordingly, a large decoupling capacitor may be needed on the output to hold the charge and provide the load current. The use of the large decoupling capacitor means a large chip size. By contrast, the present disclosure describes a hybrid digital/analog approach that provides the bandwidth of a digital circuit, while also providing a limited output noise ripple with minimum die size and power consumption. Accordingly, the low-dropout voltage regulator of certain embodiments may be considered a hybrid analog-digital low-dropout regulator.

The impedance of resistor R1 can be selected to shape the current frequency response between $V_{FB}$ and $V_{OUT}$. As a result, the capacitance at the node for $V_{FB}$ can be low, and a large voltage of the signal can be provided to error amplifier 310. As a result, fast output response from the large feedback signal may be achieved. This aspect of certain embodiments may be viewed as a first branch of the circuit.

In a second branch of the circuit, the combination of resistor R2 and $C_{load}$ may form a low pass filter. The value of resistor R2 can be tuned according to a desired frequency response of the low pass filter for the load to provide current and minimize output node noise. When the output load is low, resistor R2 may block some of the currents from transistor mp0, thereby reducing ripple at the output.

Thus, this circuit can be viewed as a digital assisted analog design. With this design a load decoupling capacitor may be much smaller than that of a purely analog design.

Figure 4:
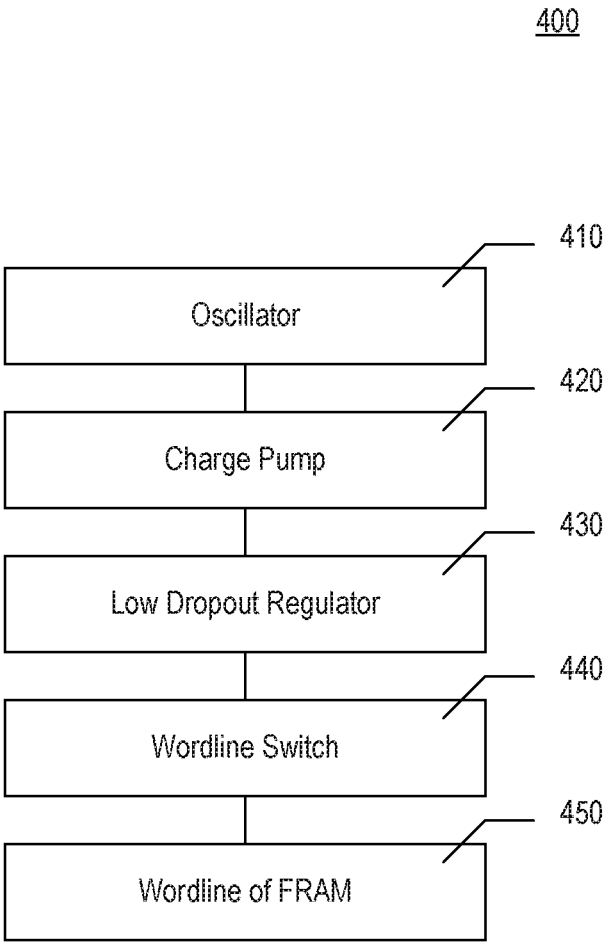
FIG. 4 illustrates a system for implementing a low-dropout regulator according to certain embodiments.

FIG. 4 illustrates a system for implementing a low-dropout regulator according to certain embodiments. As shown in FIG. 4, an example of a system 400 for supplying power to a wordline of a FRAM device can include an oscillator 410, a charge pump 420, a low-dropout regulator 430, a wordline (WL) switch 440, and a wordline in a FRAM driving circuit.

The system 400 can provide the ferroelectric memory device with a wide range output voltage to support staircase linear program operations. Since the system 400 has high output regulated voltage, such as 25V, and a fast rising time for an arbitrary load capacitance, the charge pump 420 can be used to elevate a supplied voltage to a higher voltage. The oscillator 410 can be used to generate periodic clock signals and provide driving signals to the charge pump 420.

The low-dropout regulator 430 can be any of the disclosed LDOs described above in connection with, for example, FIG. 3. The low-dropout regulator 430 can be used to draw large current and low output regulated voltage for a staircase program pulse. The output of the low-dropout regulator 430 can be used to drive a selected wordline 450 through a wordline switch 440 during a program operation in the FRAM memory device. Wordline 450 may be, for example, provided as the wordline shown in FIG. 1. A single ferroelectric memory device may include numerous ferroelectric capacitors, with corresponding bitlines, wordlines, and platelines. Each wordline, such as wordline 450, may have its own corresponding wordline switch 440, which may be provided with voltage from low-dropout regulator 430.

Power management techniques and systems can be used to reduce the standby power consumption of low-power portable applications such as mobile phones and personal digital assistants (PDAs). A low-dropout regulator is an example of a voltage regulator that is used in power management integrated circuits. They are especially suitable for applications that require a low-noise and precision supply voltage with minimum off-chip components. For example, they are particularly applicable, as described above, to FRAM systems and circuits.

Figure 5:
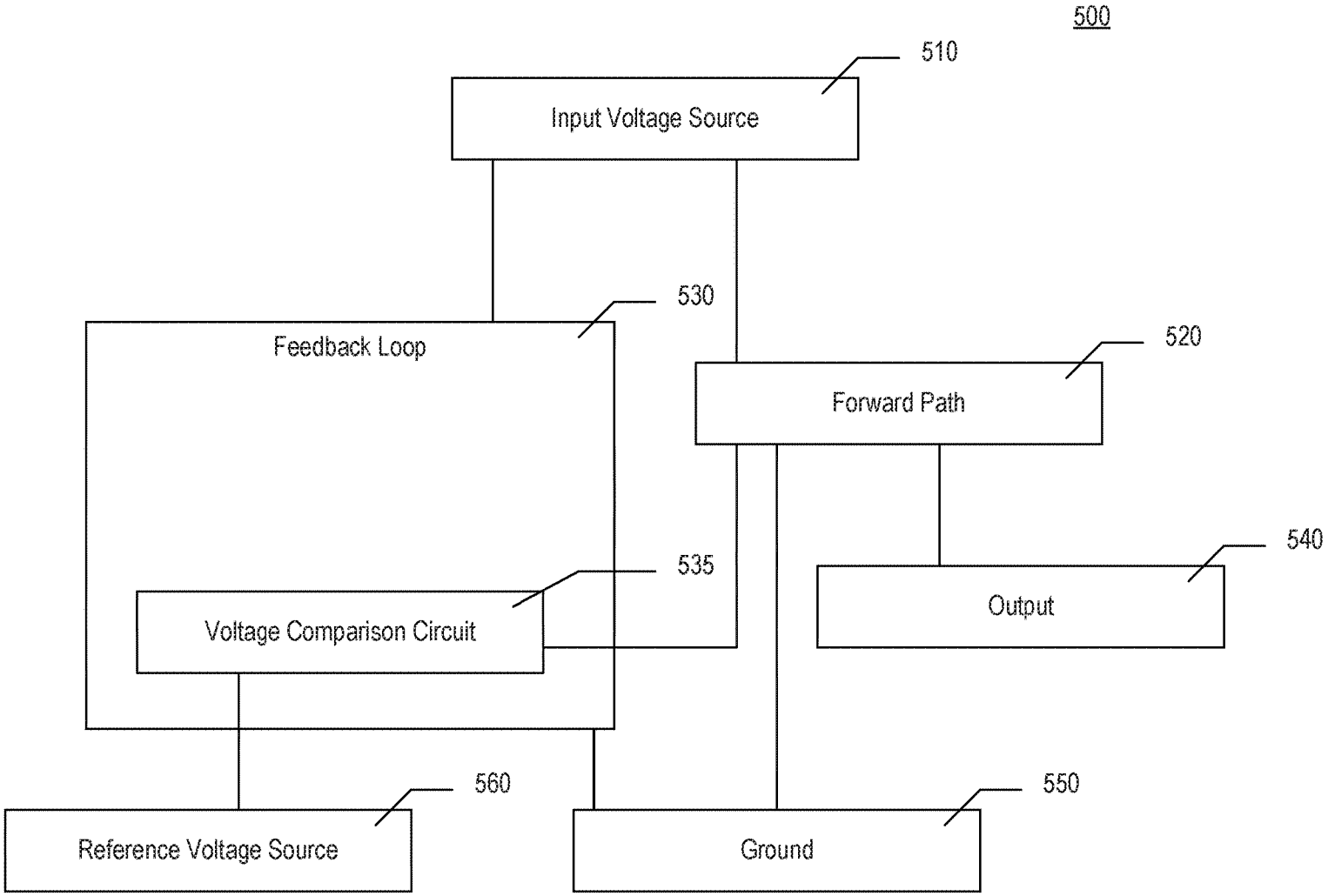
FIG. 5 illustrates a functional block diagram of an LDO according to certain embodiments.

FIG. 5 illustrates a functional block diagram of an LDO according to certain embodiments. As shown in FIG. 5, for the LDO 500, power can be supplied from an input voltage source 510, which may correspond to Vcc in FIG. 3. The input voltage source 510 can provide an input voltage to a forward path 520 and a feedback loop 530.

Forward path 520 may include a tunable circuit configured to provide voltage and current to output 540. Forward path 520 may include, for example, transistor mp0, load capacitor $C_{load}$ and resistor $R_2$ in FIG. 3. Output 540 in FIG. 5 may be a circuit that receives power from the LDO 500, such as a wordline of a FRAM, as shown in FIG. 4. The forward path 520 may also be connected to ground 5, for example, through a load capacitor as shown in FIG. 3.

Feedback loop 530 may include a voltage comparison circuit 535, which may be provided with a reference voltage from a reference voltage source 560. The reference voltage source 560 may be isolated from or based on the input voltage source 510. The reference voltage source 560 may correspond to Vref in FIG. 3. The feedback loop 530 may have a connection to ground 550.

The voltage comparison circuit 535 may include an error amplifier, such as error amplifier 310 in FIG. 3. Other implementations are also possible.

An analog LDO may have fixed internal node biases with a fixed current load. This approach may require stability and compensation. While doing compensation, the bandwidth of the closed-loop may be dramatically reduced. On the other hand, a digital LDO may not be a stable circuit. The nodes inside the loop may oscillate even with fixed output current. As long as the output voltage is within a given specification, for example, within an acceptable noise range or power limitations, other benefits, such as the benefit of digital circuit bandwidth, can obviate the need to do compensation for stability. The bandwidth of digital LDO may be, for example, 100 times higher than that of an analog LDO equivalent.

This disclosure has provided some examples of a digital LDO design that may further reduce output noise and increase feedback error voltage through the introduction of two resistors, and two paths. For example, one resistor, such as R1 in FIG. 3, can be tuned for output frequency response based on load, while another resistor, such as R2 in FIG. 3, can be tuned to provide a larger error voltage to increase the response time of the error amplifier.

The foregoing description of the specific embodiments will so reveal the general nature of the present disclosure that others can, by applying knowledge within the skill of the art, readily modify and/or adapt for various applications of such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Embodiments of the present disclosure have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The Summary and Abstract sections may set forth one or more but not all exemplary embodiments of the present disclosure as contemplated by the inventor(s), and thus, are not intended to limit the present disclosure and the appended claims in any way.

The breadth and scope of the present disclosure should not be limited by any of the above-described exemplary embodiments, but should be defined only in accordance with the following claims and their equivalents.

What is claimed is:

1. A low dropout regulator, comprising:

a first circuit path configured to regulate an input voltage to an output voltage at a load, wherein the first circuit path comprises: a first transistor, a first resistor in series with the first transistor, and a load capacitor connected to the load, wherein the first resistor and the load capacitor are configured to form a low pass filter, wherein the first resistor is tuned to provide a predetermined frequency response for the load;

a second circuit path configured to feed back an error signal based on the input voltage and the output voltage, wherein the second circuit path comprises an error amplifier; and a second resistor between the first circuit path and the second circuit path, wherein the second resistor is tuned to block current from the second circuit path to the first circuit path, wherein the second circuit path comprises a second transistor, wherein the second transistor is controlled by a same input as the first transistor, wherein the input is provided via a common node, wherein the common node is isolated from the output voltage by the second transistor and the first transistor, and wherein the second circuit path further comprises a pair of complementary transistors between the error amplifier and the common node, wherein the pair of complementary transistors are configured to transmit either the input voltage or ground to the common node based on an output of the error amplifier, wherein the common node is isolated from the error amplifier by the pair of complementary transistors.

2. The low dropout regulator of claim 1; wherein the first transistor comprises a p-type transistor.

3. The low dropout regulator of claim 1, wherein the second transistor comprises a p-type transistor.

4. The low dropout regulator of claim 1, wherein the first resistor is configured to block some of the currents from the first transistor.

5. The low dropout regulator of claim 1, wherein the first resistor has a constant resistance.

6. A low dropout regulator, comprising:

a voltage input line;

a first transistor connected to the voltage input line at a first node of the first transistor;

a first resistor connected to the first transistor at a second node of the first transistor and connected to an output node;

a load capacitor connected to the output node, wherein the first resistor and the load capacitor are configured to form a low pass filter, a second circuit path connected to a third node of the first transistor and configured to control the first transistor via the third node; and a second resistor connected to the output node and configured to block a path between the second circuit path and the output node, wherein the second circuit path comprises a second transistor connected to the voltage input line at a first node of the second transistor and connected to an error input of an error amplifier at a second node of the second transistor, wherein a third node of the second transistor is common with the third node of the first transistors, wherein the second circuit path further comprises a pair of complementary transistors configured to transmit, to the third node of the second transistor and to the third node of the first transistor, a selected one of an input voltage and ground, wherein the third node of the second transistor and the third node of the first transistor are respectively isolated from the output node by the second transistor and the first transistor and wherein the third node of the second transistor and the third node of the first transistor are isolated from the error amplifier by the pair of complementary transistors.

7. The low dropout regulator of claim 6, wherein the error amplifier is configured to control the pair of complementary transistors based on the error input and a reference voltage.

8. A circuit for driving a ferroelectric memory, the circuit comprising:

a plateline;

a bitline;

a wordline;

a ferroelectric capacitor configured to be addressed by e bitline and the wordline, and configured to be read and written using the plateline in cooperation with the bitline and the wordline;

a low-drop out regulator configured to supply a transistor of the wordline, wherein the low-drop out regulator comprises a hybrid analog-digital low-dropout regulator, wherein the hybrid analog-digital low-dropout regulator comprises a control node configured to control operation of the hybrid analog-digital low-dropout regulator, wherein the control node is isolated from an output of the hybrid analog-digital low-dropout regulator; and an input voltage source connected to the hybrid analog-digital low-dropout regulator, wherein the hybrid analog-digital low-dropout regulator comprises a first circuit path configured to regulate an input voltage from the input voltage source to an output voltage at the transistor of the wordline, wherein the first circuit path comprises a first transistor, a first resistor in series with the first transistor, and a load capacitor connected to the output, wherein the first resistor and the load capacitor are configured to form a low pass filter, wherein the first resistor is tuned to provide a predetermined frequency response for the transistor of the wordline, a second circuit path configured to feed back an error signal based on the input voltage and the output voltage, wherein the second circuit path comprises an error amplifier, wherein the control node is isolated from the output by the first transistor and from the error amplifier by a pair of complementary transistors, and a second resistor between the first circuit path and the second circuit path, wherein the second resistor is tuned to block current from the second circuit path to the first circuit path.

9. The circuit of claim 8, wherein the second circuit path comprises a second transistor, wherein the second transistor is controlled by a same input as the first transistor, wherein the input is provided via a common node, wherein the control node is further isolated from the output by the second transistor, and wherein the common node is the control node.

10. The circuit of claim 9, wherein the pair of complementary transistors is between the error amplifier and the common node, wherein the pair of complementary transistors is configured to transmit either the input voltage or ground to the common node based on an output of the error amplifier.

11. The circuit of claim 8, further comprising: a voltage input line connected to the hybrid analog-digital low-dropout regulator, wherein the hybrid analog-digital low-dropout regulator comprises: the first transistor connected to the voltage input line at a first node of the first transistor, and the first resistor connected to the first transistor at a second node of the first transistor and connected to an output node at the transistor of the wordline, wherein the second circuit path connected to a third node of the first transistor and configured to control the first transistor via the third node, wherein the third node is the control node.

* * * * *